United States Patent [19]

Walker

[11] 3,971,238

[45] July 27, 1976

[54] KEY ACTUATED AUXILIARY DOOR HOLDING MEANS

[76] Inventor: Brooks Walker, 807 Francisco St., San Francisco, Calif. 94109

[22] Filed: Mar. 31, 1975

[21] Appl. No.: 563,570

[52] U.S. Cl. ..... 70/135; 70/139; 292/197

[51] Int. Cl.[2] ..... E05B 65/06

[58] Field of Search ..... 70/141, 144, 156, 101, 70/102, 103, 104, 105, 106, 135, 139; 292/197 X, 200, 83, 87, 88, 89, 224, 226, 234, 236

[56] References Cited

UNITED STATES PATENTS

| | | | |
|---|---|---|---|
| 1,104,274 | 7/1914 | Re | 70/139 |
| 2,274,259 | 2/1942 | Russo | 70/135 |
| 2,644,708 | 7/1953 | Poole | 292/236 |
| 3,431,754 | 3/1969 | Brumelle | 70/144 |
| 3,690,709 | 9/1972 | Bogosz | 292/262 |

FOREIGN PATENTS OR APPLICATIONS

| | | | |
|---|---|---|---|
| 964,488 | 3/1948 | France | 70/101 |
| 971,733 | 10/1946 | France | 70/101 |
| 528,503 | 10/1940 | United Kingdom | 292/83 |

*Primary Examiner*—Robert A. Hafer
*Attorney, Agent, or Firm*—Gordon Wood

[57] ABSTRACT

A door lock for use with an elongated rod used as an auxiliary holding device in addition to the conventional door lock. The auxiliary door holding rod is actuatable from outside the door by means of a conventional key actuated lock so as to permit the auxiliary safety rod to be moved between locked and unlocked positions from outside the door as well as from inside the door. A lost motion device is incorporated in the connection between the door lock and the rod holder to prevent interference between the lock structure and the internal manual actuation of the rod holder.

11 Claims, 5 Drawing Figures

KEY ACTUATED AUXILIARY DOOR HOLDING MEANS

This invention relates to a door lock for use with an auxiliary safety bar or rod of the type disclosed in my copending applications Ser. No. 530,686 filed Dec. 9, 1974 and Ser. No. 523199 filed Nov. 13, 1974.

The main object of the present invention is the provision of means for locking and unlocking a safety bar or rod which is employed to obtain added security in addition to the conventional door lock.

Heretofore, auxiliary door holding means have been provided to give additional security to the occupant of an apartment or house and which holding means are actuatable from inside the door only. By the present invention the auxiliary door holding means may be moved from locked to unlocked positions and vice versa from outside the door.

Other objects and advantages will be apparent from the following specification and from the drawings.

Figure 1:
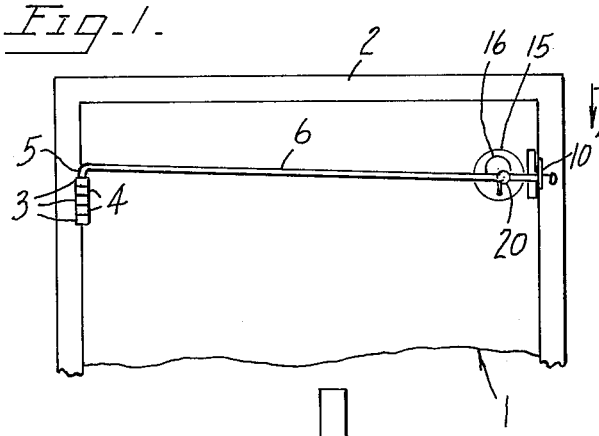
FIG. 1 is a fragmentary interior side elevation of a door and its frame showing the invention in use.

In detail and first with reference to FIG. 1, the invention is adapted to be employed with a conventional door generally designated 1, and its frame 2 to which are secured hinge knuckles 3 which cooperate with hinge knuckles 4 on the door 1 to swingably connect the door to the frame by means of the usual hinge pin. In this case the hinge pin may be removed and a laterally offset portion 5 of an elongated rod 6 may be inserted through knuckles 3, 4 to support said rod 6.

Figure 3:
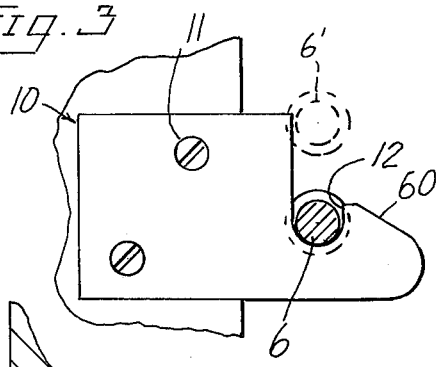
FIG. 3 is a side elevation of the keeper as taken in a plane indicated by lines 3—3 of FIG. 2.

At the opposite end of rod 6 the same cooperates with a keeper generally designated 10 which is secured to the frame 2 by means of screws 11 (FIG. 3). The keeper 10 is formed with an upwardly opening slot 12 in which the rod 6 is adapted to be received when the latter is in its door holding position. The rod 6 may be swung upwardly from its full line position of FIG. 3 to its dotted line position indicated at 6' against the inherent resiliency of said bar thus permitting the door to be opened.

Adjacent the latch edge of the door there is provided a mounting plate 15 to which is rotatably secured a base 16. This rotatable securement may be obtained by providing an inwardly extending boss 18 (FIG. 4) on base 16 and which boss is externally threaded to engage the internal threads of a bore 17 in mounting plate 15. By making said threads fine, the amount of axial movement of the base 16 relative to the mounting plate 15 is negligible.

Rotatably mounted on base 16 is a cylindrical block 20 formed with a bore 21 for slidably receiving the rod 6 therethrough. The block 20 may also be provided with an inwardly extending externally threaded boss which cooperates with an internally threaded bore 22 in base 16. By this structure removal and assembly of the lock 20 and base 16 is facilitated.

Figure 4:
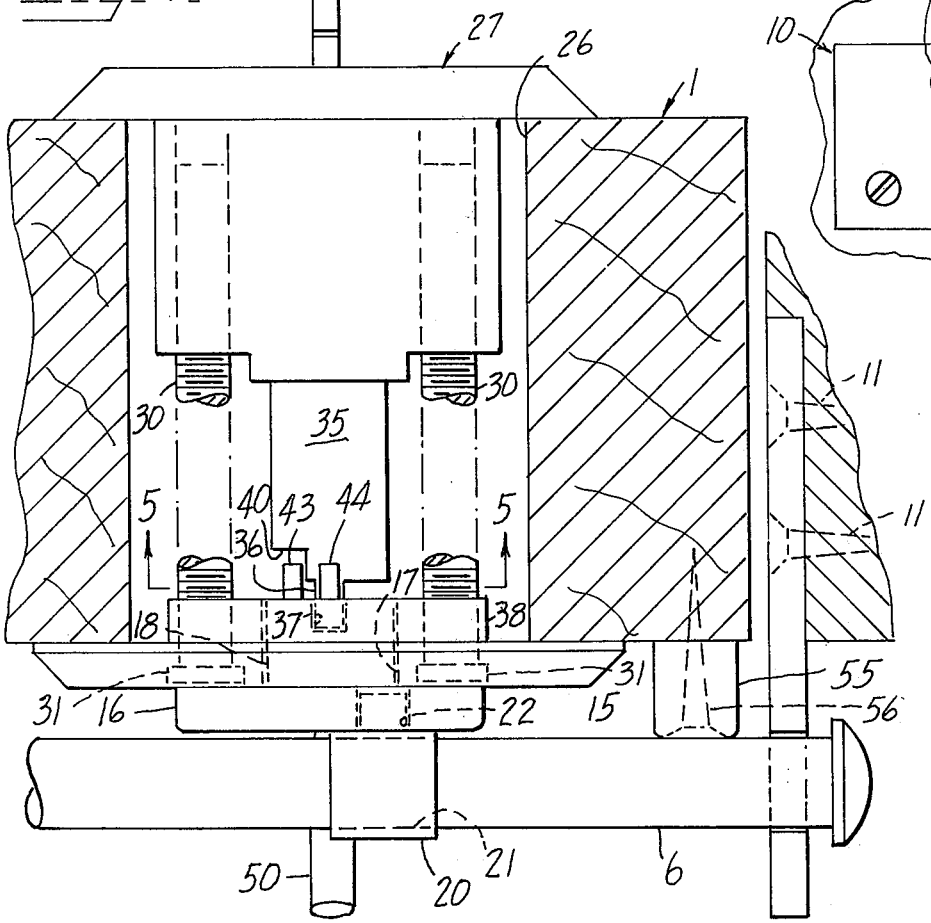
FIG. 4 is a greatly enlarged horizontal cross section through the door showing the auxiliary door latch and the key operated lock for actuating the same.

The door 1 is formed with a horizontally extending bore 26 therethrough (FIG. 4) in which is received a conventional door lock 27 adapted to be actuated by a key 28. The external door lock 27 and the internal mounting plate 15 are clamped together by means of horizontally extending elongated screws 30 which are provided with recessed heads 31 in mounting plate 15. Said screws threadedly engage the housing of the conventional lock 27 as indicated in FIG. 4 to secure the assembly in place.

The lock 27 is provided with the usual driver bar 35 which is rotated by the key 28 in the normal manner. The outer end of driver bar 35 is provided with a short extension 36 which is received within a central recess 37 in the inwardly extending boss 18 which is integral with base 16.

The driver bar 35 is provided with a notch 40 and the boss 18 of base 16 is provided with a pair of inwardly extending pins 43,44 which cooperate with the driver bar 35 in a manner to be described.

Figure 2:
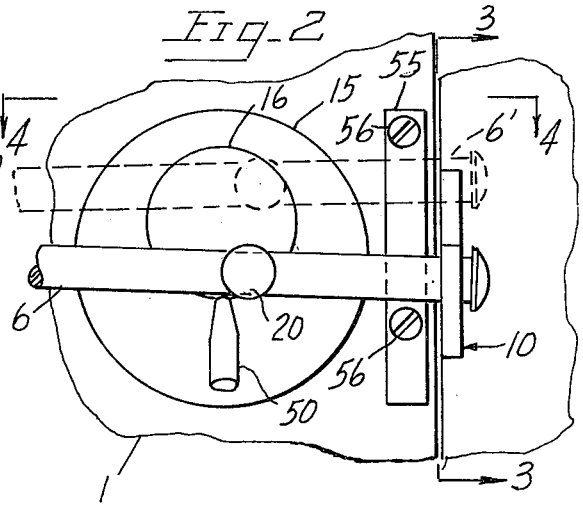
FIG. 2 is an enlarged fragmentary side elevation of the invention.
Figure 5:
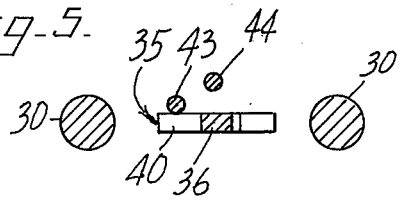
FIG. 5 is a vertical sectional view taken in a plane indicated by lines 5—5 of FIG. 4.

In the position of FIG. 5 the rod 6 is in its locked position and may be moved to its unlocked position from the inner side of the door by swinging the base 15 counterclockwise as seen in FIG. 2 by means of handle 50. From FIGS. 4, 5 it will be noted that during such opening movement, pins 43, 44 clear the driver bar 35 because of the presence of notch 40. The rod 6 may also be moved to its locked position from inside the door without interference with driver bar 35.

The bar 6 may also be unlocked from outside the door by rotating the key 28 so that the driver bar 35 rotates in a counterclockwise direction as seen in FIG. 5. In such a case the driver bar 35 rotates about 90° before engaging pin 44 and thereafter an additional 90° rotation swings the rod 6 to open position. The key 28 may then be rotated back to its original position to permit removal of the same. In this connection it will be noted that in a conventional door lock the key may be inserted and removed in only one angular position of the plug which drives the driver bar.

The bar 6 may be locked by means of key 28 by rotating the key to rotate driver bar 35 in a clockwise direction as seen in FIG. 5. In such a case driver bar 35 engages pin 43 to rotate base 16 in a clockwise direction as seen in FIGS. 2, 5.

It will be noted that notch 40 provides a lost motion means permitting locking and unlocking action from both sides of the door without interference between the base structure and the driver bar 35 when the lock is actuated from inside the door.

In order to prevent excessive forces being imparted to the rod actuating device, an elongated bearing block 55 may be interposed between the rod holding means and the latch edge of the door and secured to the latter by screws 56.

The keeper 10 may be formed with an outer camming surface 60 for swinging the rod 6 upwardly and rotating base 16 to the open position if the door is closed with the rod 6 in its locked position.

I Claim:

1. A door lock for use with a door structure that includes a door and a frame therefor, comprising:

a rod extending alongside the inner face of said door, a keeper mounted on said frame, said rod being movable vertically in a plane parallel to said inner face from a locked position in engagement with said keeper to an unlocked position out of engagement with said keeper, a base rotatably mounted on said inner face of said door, a rod holder on said base and slidably engaging said rod at a point intermediate the ends of the latter, means extending through said door from the opposite face thereof for rotating said base to move said rod between locked and unlocked positions.

2. A door lock according to claim 1 wherein said means is a rotatable driver bar of a key operated lockset on said opposite face.

3. A door lock according to claim 2 wherein said base is provided with an extension extending inwardly of said door, said extension being engageable by said driver bar to rotate said base.

4. A door lock according to claim 3 wherein lost motion means is provided between said driver bar and said base to prevent interference between said extension and said driver bar when said base is rotated from inside said door.

5. A door lock according to claim 4 wherein a second extension on said base is provided and adapted to be engaged by said bar for rotating said base in a direction opposite to that when said first mentioned extension is engaged.

6. A door lock according to claim 1 wherein said rod holder comprises a block rotatably secured to said base and formed with a bore for slidably receiving said rod therethrough.

7. A door lock according to claim 1 wherein a manually manipulatable handle is secured to said base for rotating said base from the inner side of said door.

8. A door lock according to claim 1 wherein a mounting plate is secured to said inner face and said base is threadedly secured in said plate.

9. A door lock according to claim 6 wherein said block is threadedly secured to said base.

10. A door lock for use with a door structure that includes a door and a door frame having a hinge swingably supporting said door on said frame, said lock comprising:

a rod extending across said door at the inner face thereof and pivotally supported on said hinge, a keeper on said frame at the latch edge of said door, said rod being movable vertically and parallel to said inner face from a locked position in engagement with said keeper to an unlocked position out of engagement with said keeper, a lock cylinder operable by a key from the outer face of said door, means slidably supporting said rod and actuatable by said lock cylinder to engage and disengage said rod relative to said keeper from outside the door, means operable from inside the door to engage and disengage said rod from said keeper regardless of whether said lock cylinder is in locked or unlocked condition.

11. A door lock according to claim 10 wherein said means actuatable by said lock cylinder includes a lost motion mechanism.

* * * * *